US006646207B1

(12) United States Patent
Featherstone, III

(10) Patent No.: US 6,646,207 B1
(45) **Date of Patent: *Nov. 11, 2003**

(54) DOUBLE HELIX LEAD DRESSING OF FLAT FLEXIBLE CABLES

(75) Inventor: Raymond McKay Featherstone, III, Indianapolis, IN (US)

(73) Assignee: Thomson Licensing S. A., Boulogne Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/569,671

(22) Filed: May 12, 2000

(51) Int. Cl.[7] ..... H01B 7/00

(52) U.S. Cl. ..... 174/117 F; 174/72 TR; 174/117 FF

(58) Field of Search ..... 174/117 F, 117 FF, 174/27, 113 R, 110 R, 72 TR, 72 A; 307/147

(56) References Cited

U.S. PATENT DOCUMENTS

| | | | | | |
|---|---|---|---|---|---|
| 3,296,365 | A | * | 1/1967 | Basile | 174/117 |
| 3,300,572 | A | | 1/1967 | Dahlgren et al. | |
| 3,344,392 | A | | 9/1967 | Briscoe | |
| 3,764,727 | A | | 10/1973 | Balde | 174/34 |
| 3,818,122 | A | * | 6/1974 | Luetzow | 174/86 |
| 3,836,415 | A | * | 9/1974 | Hilderbrandt | 156/296 |
| 3,878,341 | A | * | 4/1975 | Balde | 179/98 |
| 4,065,199 | A | * | 12/1977 | Andre et al. | 339/17 F |
| 4,155,613 | A | * | 5/1979 | Brandeau | 339/29 R |
| 4,861,945 | A | | 8/1989 | Buck et al. | 174/69 |
| 4,954,100 | A | * | 9/1990 | McCleerey | 439/492 |
| 4,992,625 | A | * | 2/1991 | Izui et al. | 174/36 |
| 5,259,792 | A | * | 11/1993 | Beck et al. | 439/607 |
| 5,274,195 | A | | 12/1993 | Murphy et al. | 174/117 FF |
| 5,698,821 | A | * | 12/1997 | Herman | 174/72 R |
| 5,710,393 | A | * | 1/1998 | Smith et al. | 174/74 R |
| 5,834,698 | A | * | 11/1998 | Izui et al. | 174/113 R |
| 5,939,952 | A | | 8/1999 | Noda et al. | 333/1 |
| 6,010,788 | A | * | 1/2000 | Kebabjian et al. | 428/381 |
| 6,092,944 | A | * | 7/2000 | Butler | 400/492 |
| 6,096,982 | A | * | 8/2000 | Difrancesco | 174/268 |

FOREIGN PATENT DOCUMENTS

| | | |
|---|---|---|
| EP | 0701927 | 3/1996 |
| GB | 382329 | 10/1932 |
| WO | 96/23339 | 8/1996 |

OTHER PUBLICATIONS

*Electronics Products Magazine*, Oct. 1960, p. 13.
3M Company, Apr. 21, 1969.

* cited by examiner

*Primary Examiner*—Dean A. Reichard
*Assistant Examiner*—William H. Mayo, III
(74) *Attorney, Agent, or Firm*—Joseph S. Tripoli; Carols M. Herrera; Patricia A. Verlangieri

(57) ABSTRACT

A method and apparatus for providing a flat cable assembly in which two or more flat cable sub-assemblies having respective non-orthogonal proximate terminations and respective non-orthogonal distal terminations are adapted to form a substantially straight helix structure providing a self-supporting cable assembly while reducing mechanical stresses on termination points.

13 Claims, 3 Drawing Sheets

DOUBLE HELIX LEAD DRESSING OF FLAT FLEXIBLE CABLES

BACKGROUND OF THE INVENTION

1. Field of the Invention

The present invention relates generally to electrical circuit module interconnecting cables and, more specifically, to an interconnecting cable utilizing a pair of flat cables adapted to form a self-supported interconnecting cable assembly.

2. Description of the Background Art

Flat flexible cables (FFCs), "ribbon" cables and other flat cabling technologies are well known in the electronics industry as a means of electrical systems interconnection. Among the advantages provided by flat cables are simple, low cost systems assembly and ease in mass termination, since all the conductors of a flat cable are fixed in known relationship to one another in a flat, easy to handle, array. Such cables may be manufactured, for example, by coating and laminating operations or by etching or adhesive deposition techniques.

Ribbon cables, for example, are typically terminated using insulation displacement connectors to form cable assemblies suitable for interconnecting printed circuit boards, circuit modules and other electrical and electronic devices. The retention force of such insulation displacement type connectors is relatively low, often resulting in inadvertent disassembly or disconnection. This condition may be somewhat remedied by the use of locking flight cable connectors. For non-locking flat cable connectors, an adhesive is typically added to improve the retention force of the connector.

Unfortunately, the cost of a cable assembly is increased due to the use of an adhesive, though such cost increase is less than the cost of a locking connector. Additionally, the use of an adhesive increases manufacturing complexity due to the need to controllably dispense the adhesive during the mating of the flat cable and the flat cable connector. Finally, any mismatch in the thermal coefficients of expansion between the adhesive used, the cable connector and any printed circuit board (PCB) material to which the cable connector is joined will cause mechanical stresses in solder joints that may fail over time.

Therefore, it is seen to be desirable to provide a flat cable assembly in which non-locking flat cable connectors may be used without adhesives and without experiencing undue mechanical failures.

SUMMARY OF THE INVENTION

The disadvantages heretofore associated with the prior art are overcome by the present invention of a method and apparatus for providing a flat cable assembly in which two or more flat cables having respective non-orthogonal proximate terminations and respective non-orthogonal distal terminations are adapted to form a substantially straight helix structure providing a self-supporting cable assembly while reducing mechanical stresses on termination points.

BRIEF DESCRIPTION OF THE DRAWINGS

The teachings of the present invention can be readily understood by considering the following detailed description in conjunction with the accompanying drawings, in which.

DETAILED DESCRIPTION

Figure 1:
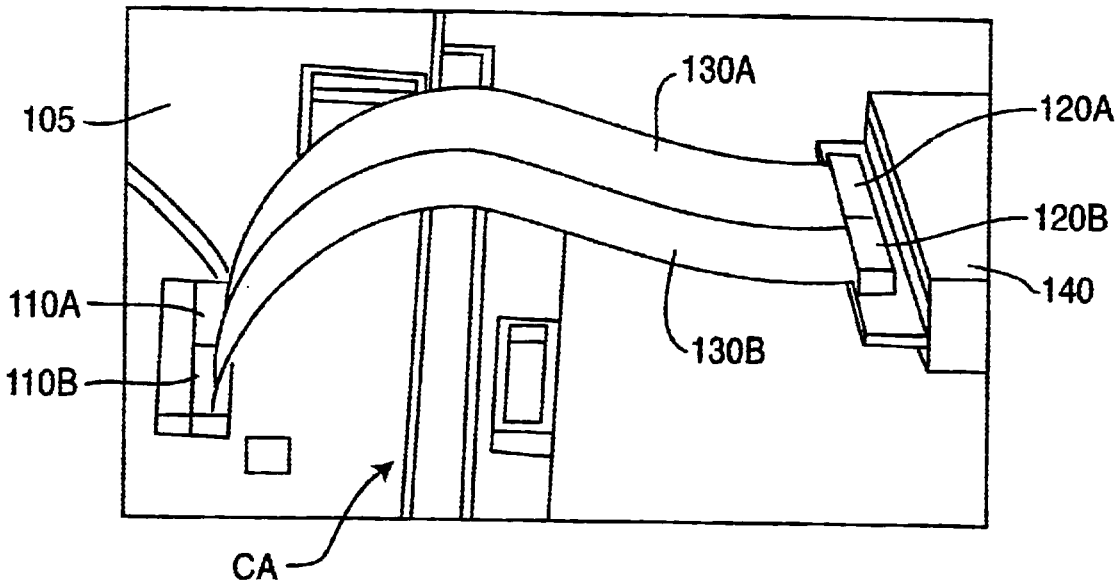
FIG. 1 depicts a flat cable assembly.

FIG. 1 depicts a flat cable assembly. Specifically, FIG. 1 depicts a printed circuit board (PCB) 105 connected to a circuit module 140 via a flat flexible cable (FFC) assembly (CA) comprising a pair of flat cables 130A and 130B having respective first or proximate terminating connectors 110A and 110B and respective second or distal terminating connectors 120A and 120B. That is, a first cable assembly is formed by connector 110A, FFC 130A and connector 120A, while a second cable assembly is formed by connector 110B, FFC 130B and connector 120B.

The respective first terminating connectors 110A and 110B electronically and mechanically couple the ribbon cables 130A, 130B to the PCB 105, while the second terminating connectors 120A, 120B electronically and mechanically couple the ribbon cables 130A, 130B to the circuit module 140. The terminating connectors 110A, 110B, 120A and 120B comprise standard ribbon cable terminating connectors, such as insulation displacement-type connectors.

Referring to FIG. 1, it is noted that various electronic components are depicted on the PC board 105. Since the particular components depicted on the PC board 105 are not relevant to the subject invention, they will not be discussed in more detail. However, it is noted that the various electronic components may include electronic components that emit radio frequency (RF) signals or other electromagnetic radiation, or are effected by RF radiation or other electromagnetic radiation. As will be discussed in more detail below, the subject invention advantageously reduces the emissions of radio frequency and other electromagnetic emissions from the cable assembly.

Figure 2:
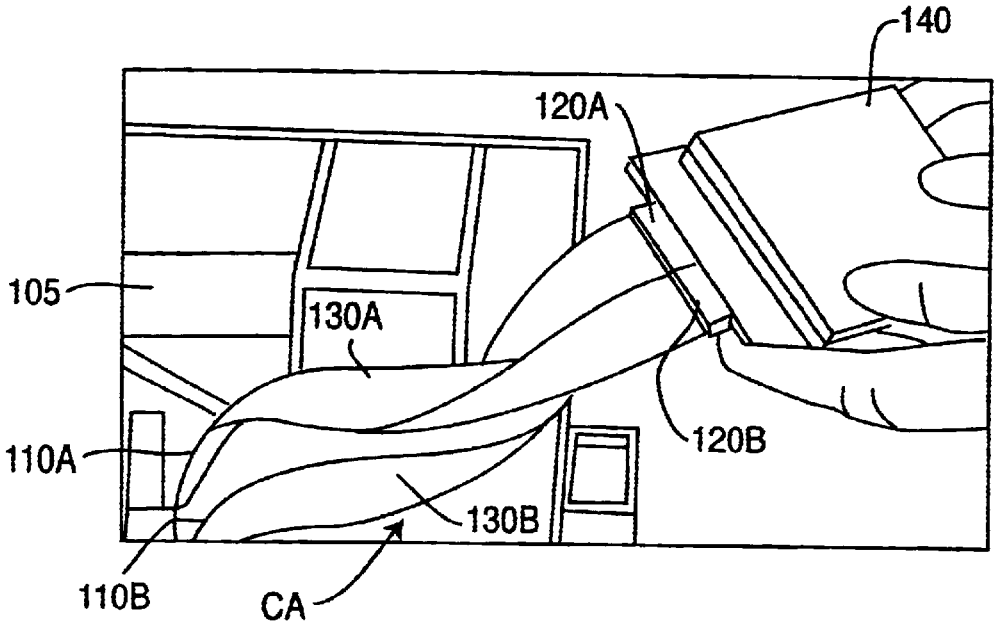
FIGS. 2–4 depict a flat cable assembly modified according to an embodiment of the invention.

FIG. 2 depicts the cable assembly of FIG. 1 as spatially modified according to an embodiment of the present invention. Specifically, FIG. 2 depicts the cable assembly of FIG. I comprising proximate connectors 110A and 110B, flat cables 130A and 130B, and respective distal connectors 120A and 120B. As previously noted, the cable assembly CA is proximally terminated at a printed circuit board 105 and distally terminated at a circuit module 140. Referring now to FIG. 2, the circuit module 140 is shown as having rotated by 180°, thereby causing a corresponding rotation of the flat cables 130A and 130B and respective distal terminations 120A and 120B as shown.

Figure 3:
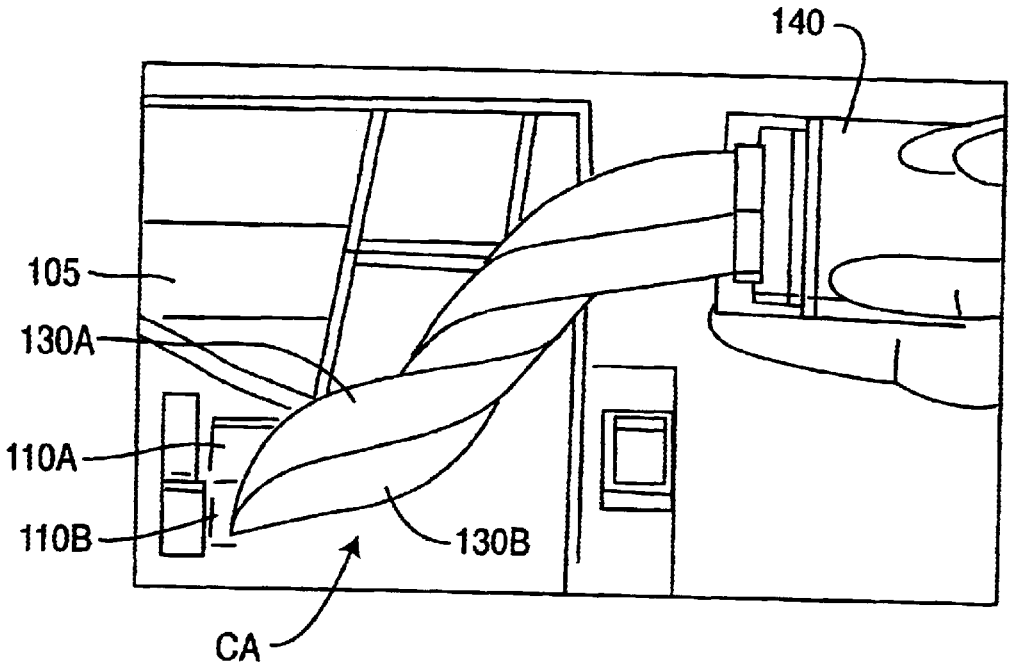

FIG. 3 depicts the cable assembly of FIG. 2 as spatially modified according to an embodiment of the present invention. Specifically, FIG. 3 depicts the circuit module 140, and corresponding cable assembly CA of FIG. 2 rotated by an additional 180 degrees, to provide thereby a full 360 degrees of rotation with respect to the initially depicted cable assembly CA of FIG. 1. In this manner, the double helix cable assembly structure. Has been formed. That is, the first 130A and second 130B flat cables have been adapted to form a double helix structure depicted in proximate connectors 110. Specifically, the double helix structure depicted in FIG. 3 comprises two flat cable assemblies (though more than two flat cable assemblies may be used) having respective non-orthogonal proximate terminations and respective terminations that have been adapted (by rotation) to form a substantially straight helix structure providing a self-supporting cable assembly. In this manner, the mechanical stresses on the cable assembly termination points are reduced, the transmission of electromagnetic radiation is reduced. Each of the non-orthogonal proximate termination connectors (110A, 110B, FIGS. 1 and 2) may be considered as being in-line or generally in-line (parallel or generally parallel) and closely adjacent to the other non-orthogonal proximate termination connectors. The respective non-orthogonal distal terminating connectors (120A, 120B, FIGS. 1 and 2) are similarly positioned with respect to each other.

Figure 4:
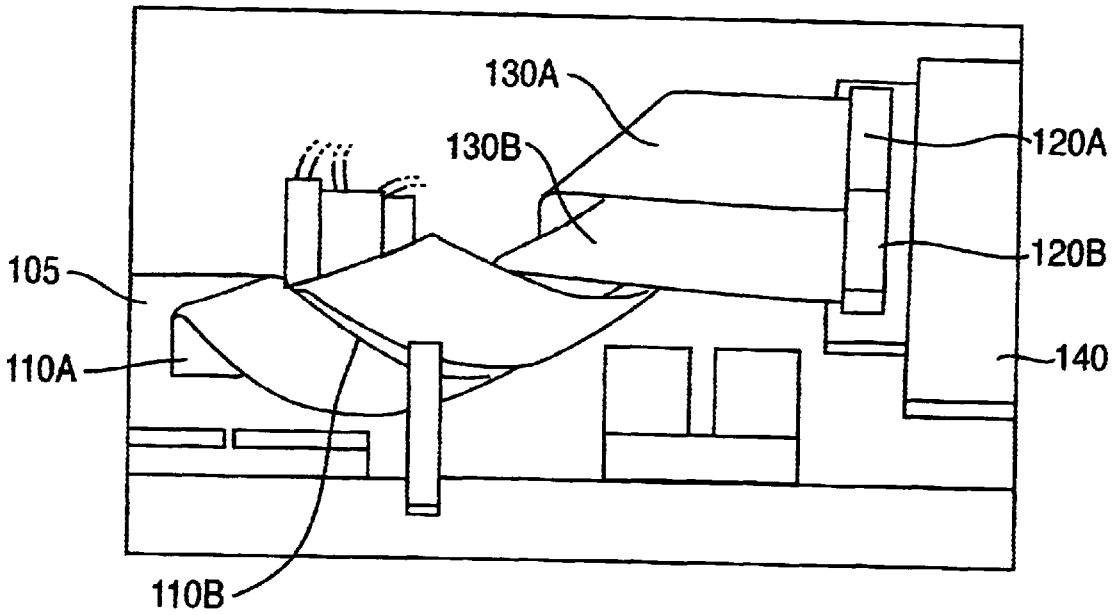

FIG. 4 depicts the cable assembly of FIG. 3 mounted within an electronic apparatus. Specifically, FIG. 4 depicts the cable assemblies described above with respect to FIGS. 1–3 wherein the PCB 105 and circuit module 140 are secured within a common housing, thereby showing the actual use of a double helix cable assembly formed according to the present invention.

Figure 5:
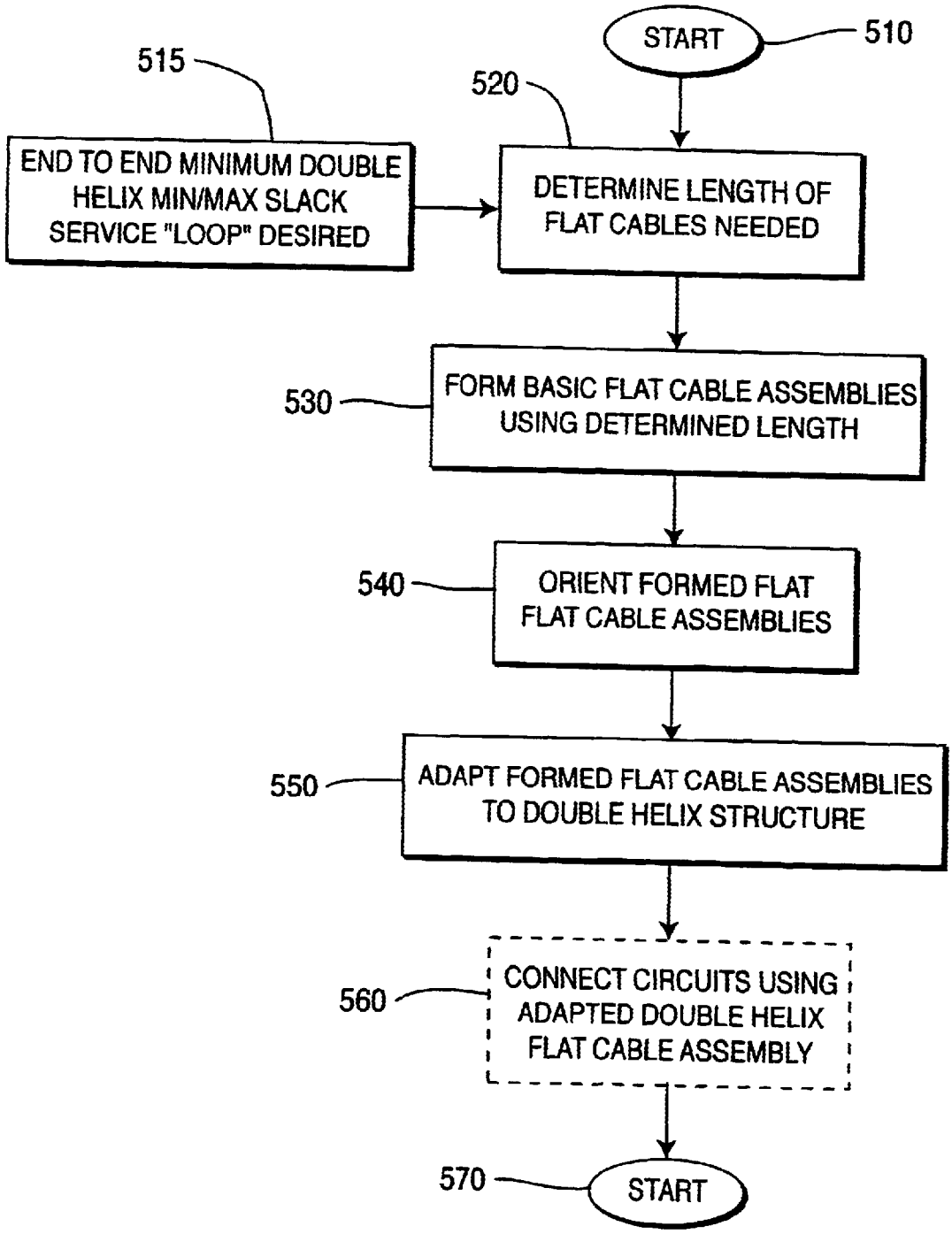
FIG. 5 depicts a flow diagram of a method of forming a double helix cable assembly according to the present invention To facilitate understanding, identical reference numerals have been used, where possible, to designate identical elements that are common to the figures.

FIG. 5 depicts a flow diagram of a method of forming a cable assembly according to the present invention. Specifically, FIG. 5 depicts a flow diagram of a method 500 suitable for use in, for example, a manufacturing or repair environment where the double helix assembly may be used.

The method 500 is entered at step 510 and proceeds to step 520, where the length of the flat cable needed to provide the appropriate circuit interconnections is determined. That is, referring to box 515, parameters such as the end-to-end minimum length, the double helix minimum/maximum slack and any service "loop" is used to determine the length of the flat cables. The end-to-end minimum comprises the minimum distance between a proximate connector and distal connector within a cable assembly electrically coupling two circuits (e.g., between connectors 110 of PCB 105 and 120 of circuit module 140). The double helix minimum slack parameter comprises a length allowance for a minimum amount of slack within a double helix cable assembly configuration. It is noted that a length less than a minimum slack parameter will result in a cable assembly that cannot be formed into a double helix cable assembly without unduly stressing the various connectors. The double helix maximum slack parameter comprises a length allowance for a maximum amount of slack within a double helix cable assembly configuration. It is noted that a length greater than a maximum slack parameter will result in a "droopy" double helix cable assembly, which may disadvantageously require additional securing means such as clamps to route properly between the two circuit connections. A "service loop"0 comprises a length allowance for accessing electrical components that are connected using the double helix cable assembly. The method 500 then proceeds to step 530.

At step 530, the basic flat cable assemblies are formed using the determined length. That is, each of the single or basic flat cable assemblies are formed using the length parameter determined at step 520. It must be noted that the basic flat cable assemblies may be formed using individual connectors or common connectors. The method 500 then proceeds to step 540.

At step 540, the formed flat cable assemblies are oriented such that the connectors are in proper orthogonal relationships. That is, in the case of a plurality of FFC assemblies having individual connectors, the respective proximate and distal connectors are aligned such that the cable assemblies are substantially "in-line" (that is, co-planar or parallel planar). The method 500 then proceeds to step 550.

At step 550, the formed and oriented flat cable assemblies are adapted to form the double helix structure of the present invention. That is, one end of the oriented flat cable assemblies (proximate or distal) is rotated by, for example, 360° such that the double helix structure shown above with respect to FIGS. 1–4 is formed. It will be appreciated by those skilled in the art that a rotation of exactly 360° is not necessary to practice the invention. Rather, rotations of more or less than 360° may be used within the context of the present invention. For example, by rotating more than 360°, a "tighter" double helix structure is formed in which a greater initial cable length may be tolerated (e.g., to provide for a greater service loop). By rotating less than 360°, a "looser" double helix structure is formed in which a shorter initial cable length may be tolerated. The method 550 then proceeds to optional step 560.

At optional step 560, the circuits using the adapted double helix flat cable assembly are connected. That is, at step 560 the circuits, such as PCB 105 and circuit module 140 are connected using the double helix cable assembly provided at step 550. The method 500 then proceeds to step 570 where it is exited.

By controlling the length of the flat cables 130A and 130B, the double helix cable assembly (or lead dressing) formed according to the present invention will keep the flat cables positioned in space in a relatively straight line between the two ends of the cable (i.e., between the proximate and distal ends of the cable assemblies). This means that the double helix lead dress will ideally work if the desired position of the cable assembly CA is in a straight line between the two ends. It is noted by the inventors that such a cable positioning is common within the electronics industry. As such, it has been anticipated that the lead dress assembly of the present invention will have wide applicability within the art of cable lead dressing.

Advantageously, the double helix lead dressing of the present invention is accomplished without the use of extra features or parts. Specifically, it is noted that the double helix lead dress cable will support itself in space, thereby avoiding the use of clamps and other means to provide such support. Moreover, since the force exerted by the lead dressing on the connectors is relatively low, the standard insulation displacement connectors may be used without the use of glue or other locking mechanisms intended to combat that force and reduce connection problems caused by cable stress.

The double helix lead dress configuration creates extra slack within a cable assembly. While this may add to the cost of the cables, as compared to returning them directly between two modules (e.g., PCB 105 and circuit module 140), such slack provides an important benefit. Specifically, if the cable assembly is pulled during handling, which often occurs during the assembly and/or testing processes, the force of such pull on the cable assembly is not directly transmitted to the connectors 110 or 120. That is, the force on such a cable assembly simply takes slack out of the cable, rather than transmitting the force to cable connectors. If the double helix is pulled completely taut, it would still pull out easily. However, it is intended that there be adequate slack in the double helix to be able to tolerate most rough handling that is typically expected during assembly and/or testing of electronic devices.

Advantageously, the double helix cable lead dressing increases the electromagnetic shielding of the cable assembly. That is, in a manner similar to that of a twisted pair of cable, the double helix cable assembly form intertwines the two flat flexible cables such that the respective electromagnetic fields produced by current flow through the cables tend to cancel or offset each other. In this manner, the double helix cable assembly of the present invention is less prone to radiating energy than other cable assemblies, while also being less susceptible to external radiation.

It will be appreciated by those skilled in the art that the present invention may be utilized within the context of a "double" helix cable assembly in which more than two cable sub-assemblies or flat cables are provided. That is, many flat cable sub-assemblies having respective non-orthogonal proximate terminations and respective non-orthogonal distal terminations may be adapted according to the teachings of the present invention to provide a double helix or other helix structure. Moreover, while the invention is primarily described within the context of electrical cables (i.e., cables including electrical conductors for conducting electrical signals thereon), it will be appreciated by those skilled in the art that other types of information signal conductors may be utilized. For example, fiber optic cables or other non-conductive information bearing channels arranged in a planar manner may be used within the underlying flat cables used to form the helix structures of the present invention.

Although one embodiment which incorporates the teachings of the present invention has been shown and described in detail herein, those skilled in the art can readily devise many other varied embodiments that still incorporate these teachings.

What is claimed is:

1. Apparatus, comprising:

a first flat cable, for conducting electrical signals between a first plurality of terminals and a second plurality of terminals;

a second flat cable, separate from said first flat cable, for conducting electrical signals between a third plurality of terminals and a fourth plurality of terminals;

said first plurality of terminals and said third plurality of terminals sharing a common orientation;

said second plurality of terminals and said fourth plurality of terminals sharing a common orientation;

said first plurality of terminals and said third plurality of terminals being substantially co-planar;

said second plurality of terminals and said fourth plurality of terminals being substantially co-planar;

said first and second flat cables being twisted around each other to form a double helix structure by rotating each of the cables in a sense to intertwine them so that the respective electromagnetic fields produced by current flow through the cables tend to cancel each other, said double helix structure comprising a first helix formed from said first flat cable from one end thereof to the other end and a second helix formed from said second flat cable from one end thereof to the other end and with each of the two helixes being wrapped around the other; and said double helix being formed as a smooth structure free of folds, slits and sharp bends in either of said first flat cable and said second flat cable.

2. The apparatus of claim 1, wherein said first and second flat cables are adapted to form a double helix structure by rotating either said first and third pluralities of terminals or said second and fourth pluralities of terminals by more than 180°.

3. The apparatus of claim 2, wherein said rotation is greater than 360°.

4. The apparatus of claim 1, wherein said first and second cables are adapted to form a double helix structure by rotating either said first and third pluralities of terminals or said second and fourth pluralities of terminals by more than 360°.

5. The apparatus of claim 1, wherein said first and second flat cables have length parameters determined with respect to a minimum end-to-end length selected to achieve a desired connection and a minimum amount of slack to be allocated to said double helix structure.

6. The apparatus of claim 5, wherein said length is determined with respect to a maximum amount of slack to be allowed within said double helix cable assembly.

7. Apparatus, comprising:

first and second separate flat cable assemblies, each assembly having respective non-orthogonal proximate terminations having termination connectors that are co-planar with respect to each other and respective non-orthogonal distal terminations having termination connectors that are co-planar with respect to each other,said said flat cable assemblies being twisted around each other to form a substantially straight double helix structure providing thereby a self-supporting cable assembly, and wherein said flat cable assemblies of said substantially straight double helix structure being rotated and intertwined with a rotation selected such that the respective electromagnetic fields produced by current flow through the cables tend to cancel each other, said double helix structure comprising a first helix formed from said first flat cable assembly, from one end thereof to the other end, and a second helix formed from said second flat cable assembly, from one end thereof to the other end, and with each of the two helixes being wrapped around the other; and wherein said double helix structure being formed as a smooth structure free of folds, slits and sharp bends in either of said first flat cable and said second flat cable.

8. The apparatus of claim 7, wherein said plurality of flat cable assemblies are adapted to form said double helix structure by rotating, by at least 180°, said non-orthogonal proximate terminations or said non-orthogonal distal terminations.

9. The apparatus of claim 8, wherein said rotation is greater than 180°.

10. A method for providing a cable assembly, comprising the steps of:

determining a length for each of a plurality of flat cables to be used in said cable assembly;

forming a plurality of separate flat cable assemblies according to said determined length;

orienting each of said formed flat cable assemblies to provide a substantially common orientation of respective proximate and distal connectors said proxmate connectors being co-planar with respect to each other and said distal connectors being co-planar with respect to each other;

intertwining at least first and second ones of said formed flat cable assemblies into a double helix structure by rotating one of said group of proximate connectors or distal connectors;

selecting said rotation such that the respective electromagnetic fields produced by current flow through the intertwined cables of said double helix structure tend to cancel each other and wherein the step of intertwining comprises:

forming a first helix from the first flat cable assembly, from one end thereof to the other end, forming a second helix from the second flat cable assembly, from one end thereof to the other end, and wrapping each of the first and second helixes around each other to form a double helix structure; and wherein said double helix structure being formed as a smooth structure free of folds, slits and sharp bends in either of said first flat cable and said second flat cable.

11. The method of claim 10, wherein said length of said flat cables is determined with respect to a minimum end-to-end length to achieve a desired connection and a minimum amount of slack to be allocated to said double helix cable structure.

12. The method of claim 11, wherein said length is determined with respect to a maximum amount of slack to be allowed within said double helix cable assembly.

13. The method of claim 10, further comprising the step of rotating said proximal or distal portion of said cable assembly by an additional amount.

* * * * *